United States Patent [19]

Uozumi

[11] Patent Number: 4,749,290

[45] Date of Patent: Jun. 7, 1988

[54] CORE STRUCTURE FOR ELECTROMAGNETIC PRINT HEAD

[75] Inventor: Koji Uozumi, Kanagawa, Japan

[73] Assignee: NHK Spring Co., Ltd., Yokohama, Japan

[21] Appl. No.: 894,034

[22] Filed: Aug. 7, 1986

[30] Foreign Application Priority Data

Oct. 29, 1985 [JP] Japan ..... 60-240481

[51] Int. Cl.[4] ..... B41J 3/12

[52] U.S. Cl. ..... 400/124; 101/93.05

[58] Field of Search ..... 400/121, 124, 157.2; 101/93.04, 93.05, 93.29, 93.48

[56] References Cited

U.S. PATENT DOCUMENTS

| | | | |
|---|---|---|---|
| 4,541,745 | 9/1985 | Gugel | 400/124 |
| 4,600,323 | 7/1986 | Harada et al. | 400/124 |
| 4,602,881 | 7/1986 | Prevignano et al. | 400/124 TC |
| 4,618,276 | 10/1986 | Blomquist et al. | 400/124 |

FOREIGN PATENT DOCUMENTS

| | | | |
|---|---|---|---|
| 2469288 | 5/1981 | France | 400/124 |
| 21869 | 2/1981 | Japan | 400/124 |
| 163578 | 10/1982 | Japan | 400/124 |
| 184668 | 10/1984 | Japan | 400/124 |
| 2030520 | 4/1980 | United Kingdom | 400/124 |

*Primary Examiner*—David Wiecking

*Attorney, Agent, or Firm*—Jeffers, Hoffman & Niewyk

[57] ABSTRACT

In a print head comprising a plurality of magnetic circuits each of which comprises an armature supported by a spring, a permanent magnet for biasing the armature in one direction, and an electromagnet which can be energized so as to cancel the biasing force of the permanent magnet, so that a print wire fixed to the armature may be driven by energizing the electromagnet and thereby driving the armature with the restoring force of the spring. The cross-sectional areas of the paths of magnetic flux between neighboring electromagnet circuits are made uneven. This can be achieved by providing base portions which are common to two electromagnet core portions. Thereby, the print pressure of all the print wires is made uniform and an increase in printing speed and improved print quality can be achieved at the same time.

8 Claims, 3 Drawing Sheets

CORE STRUCTURE FOR ELECTROMAGNETIC PRINT HEAD

BACKGROUND OF THE INVENTION

This invention relates to an electromagnetic print head, comprising a plurality of magnetic circuits each of which comprises an armature supported by a spring, a permanent magnet for biasing the armature in one direction, and an electromagnet which can be energized so as to cancel the biasing force of the permanent magnet, so that print means fixed to the armature may be driven by energizing the electromagnet and thereby driving the armature with the restoring force of the spring, and in particular to such a printer which is adapted to high speed printing and can produce uniform print pressure.

A dot matrix printer of this type, which is sometimes called as a spring charge type printer, is shown for instance in U.S. Pat. No. 4,389,127 issued June 21, 1983. A printer of this type typically includes 9, 16 or 24 sets of print means or print wires and magnetic circuits, and is widely used for printing alphanumeric characters and Japanese characters as dot matrices.

In such a printer, it is necessary to have a number of independent magnetic circuits to achieve selective energization of the print means such as print wires for dot matrix printing and, since the mass of inertia of the print head is desired to be minimized for rapid reciprocating motion of the print head, the size of the print head is desired to be minimized.

Therefore, the structure is often so cramped that some interferences between the magnetic circuits are unavoidable to a certain extent. The magnetic interferences between magnetic circuits may cause some fluctuations in the electromagnetic force for a certain magnetic circuit in canceling the magnetic force of the permanent magnet depending on the states of the magnetic circuits neighboring thereto and this can be a cause of the unevenness of the print speed or the print pressure of the print means of this particular magnetic circuit.

Therefore, conventionally, it has been believed that such interferences or cross talks between magnetic circuits in one print head are generally undesirable primarily because such interferences have been believed to be generally responsible for uneven print pressures, and in actual design of a print head it has been customary to minimize the magnetic interferences between magnetic circuits to the possible extent permitted by other design considerations Based on such recognition, the Inventor has conducted various experimental studies on the effect of such magnetic interferences between magnetic circuits of a print head particularly on print speed and print quality, and discovered that by making the magnetic couplings between neighboring magnetic circuits uneven in a certain manner the print speed can be increased without causing any substantial unevenness in print pressure.

BRIEF SUMMARY OF THE INVENTION

In view of such a discovery made by the inventor and the problems of the prior art, a primary object of the present invention is to provide a spring charge type print head which can provide good print quality and is yet capable of high speed printing.

Another object of the present invention is to provide a print head which is compact and easy to manufacture.

According to the present invention, such objects are accomplished by providing a print head, comprising a plurality of magnetic circuits each of which comprises an armature supported by a spring, a permanent magnet for biasing the armature in one direction, and an electromagnet which can be energized so as to cancel the biasing force of the permanent magnet, so that a print means fixed to the armature may be driven by energizing the electromagnet and thereby driving the armature with the restoring force of the spring, wherein: the cross-sectional areas of the paths of magnetic flux between neighboring magnetic circuits are not uniform.

According to such a structure, the differences in the flight times of print means between the time when a small number of print means are driven and the time when a large number of print means are driven can be minimized, and the increase in the print speed and the homogenization of print pressure can be achieved at the same time.

According to a certain aspect of the present invention, the magnetic circuits are clustered into a plurality of groups, each comprising for instance a pair of the magnetic circuits, in such a manner that a cross-sectional area of the path of magnetic flux between a pair of neighboring magnetic circuits belonging to a same group is greater than a cross-sectional area of the path of magnetic flux between a pair of neighboring magnetic circuits belonging to two different groups.

According to another aspect of the present invention, the print means comprise a plurality of print wires whose free ends are arranged in two rows in staggered manner, and each pair of the magnetic circuits belonging to a same group correspond to two of the print wires belonging to different ones of the rows.

According to yet another aspect of the present invention, the electromagnets comprise a core member comprising a circumferential wall, a bottom wall and a plurality of core members integrally formed with the bottom wall, each two or more of the neighboring cores having common base portions consisting of locally thickened bottom wall portions.

According to yet another aspect of the present invention, the print means comprise a plurality of print wires whose free ends are arranged in two rows in staggered manner, and each pair of the cores having a common base portion correspond to two of the print wires belonging to different ones of the rows.

BRIEF DESCRIPTION OF THE DRAWINGS

Now the preferred embodiment of the present invention is described in the following with reference to the appended drawings, in which.

DETAILED DESCRIPTION OF THE PREFERRED EMBODIMENT

Figure 1:
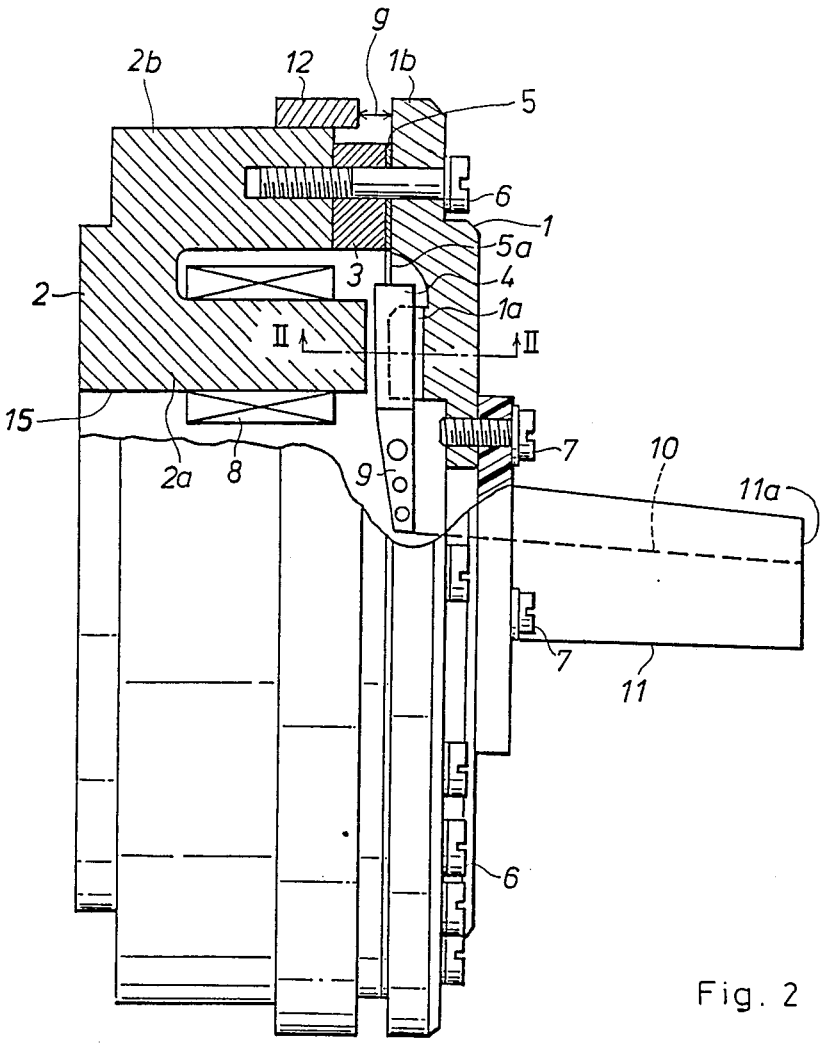
FIG. 1 is a partially broken away side view of an embodiment of the print head according to the present invention.

FIG. 1 is a partially broken away general view of a print head according to the present invention. A yoke 1 made of magnetic material and a core member 2 likewise made of magnetic material and having a suitable number of cores 2a along the circumferential direction at equal interval are assembled together with threaded bolts 6 interposing an annular permanent magnet 3 therebetween. The core member 2 is generally annular in shape and comprises, in addition to the cores 2a an outer circumferential wall 2b and a bottom wall 2c, defining a central bore 15. Further, a sheet spring 5 which is generally annular in shape and is provided with a plurality of tongues 5a extending radially inwards, is interposed between the yoke 1 and the annular permanent magnet 3.

An armature 4 is supported on the free end of each of the tongues 5a of the sheet spring 5. An end of an arm 9 is fixedly secured to each of the armatures 4 and a base end of a print wire 10 is fixedly secured to the other end of the arm 9. The print wire 10 passes through the interior of a head nose 11 which is fixedly secured to the yoke 1 with threaded bolts 7, and the free end of each of the print wires 10 reaches the free end surface 11a of the head nose 11. A solenoid 8 is wound on each of the cores 2a, and the portion of the yoke 1 opposing the free end of each of the cores 2a is provided with a slot 1a for receiving the armature 4 therein.

Figure 2:
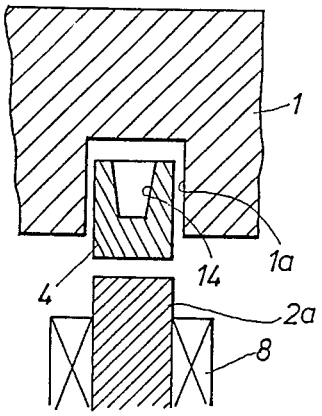
FIG. 2 is a sectional view taken along line II—II of FIG. 1.
Figure 3:
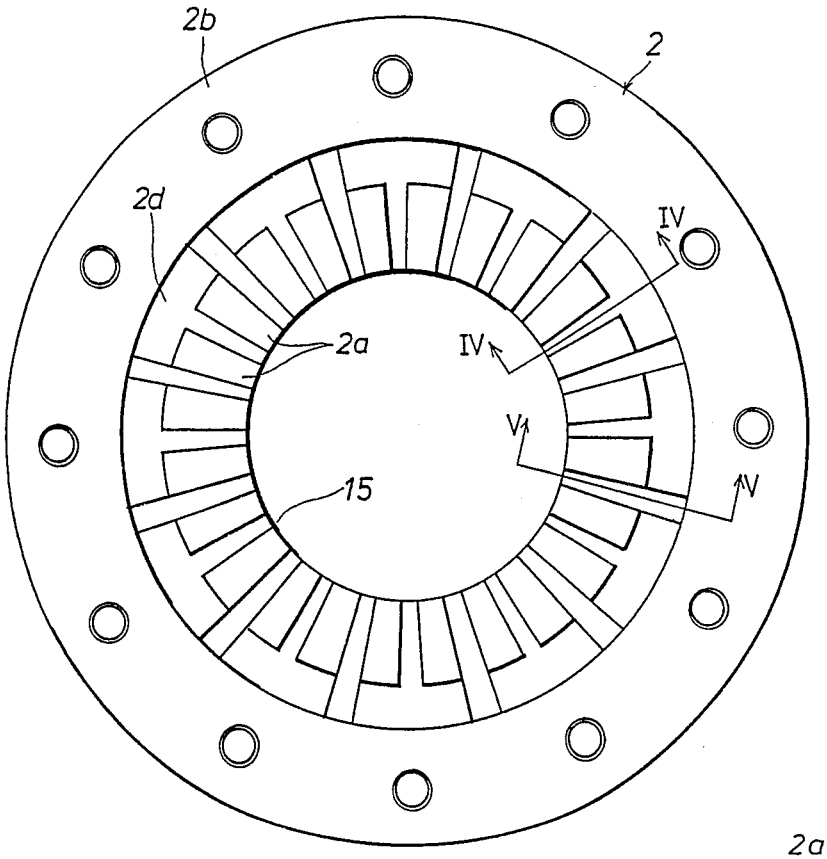
FIG. 3 is a front view showing only the core member 2 of the print head shown in FIG. 1.
Figure 6:
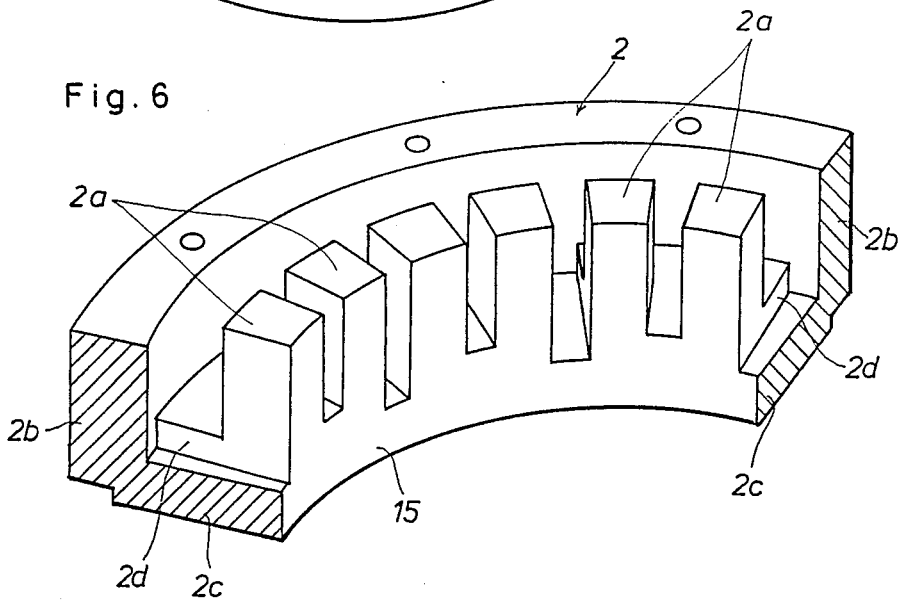
FIG. 6 is a partially broken away perspective view of the core member of FIG. 3.

Therefore, as shown in FIG. 2, the armature 4 is disposed in the magnetic gap defined between the free end surface of the core 2a and the side surfaces of the slot 1a. The armature 4 is provided with a groove 14 for reducing its mass of inertia without substantially increasing the density of the magnetic flux therein. When the solenoid 8 is not energized, the armature 4 is biased towards the free end of the core 2a under the attractive force of the permanent magnet 3 with the magnetic flux passing through the external circumferential wall 2b of the core member 2, each of the cores 2a, the armature 4, the yoke 1 and the permanent magnet 3.

When the solenoid 8 is energized at this moment so as to cancel the action of the permanent magnet 3, the armature 4 is elastically repelled from the free end surface of the core 2a by the restoring force of the tongue 5a of the sheet spring 5. Thus, the print wire 10 fixedly attached to the armature 4 by way of an arm 9 jumps out from the free end surface 11a of the head nose 11 and forms a desired print by striking a carbon ribbon and a paper surface which are not shown in the drawings.

As shown in FIG. 1, the yoke 1 is provided with a circumferential fringe portion 1b which projects radially outwards from the core member 2 and defines a gap g by opposing a ring 12 which is fitted over the outer circumferential surface of the core member 2. Thus, the permanent magnet 3 is magnetically short-circuited by the magnetic gap g defined between the fringe 1b of the yoke 1 and the ring 12 fitted onto the outer circumferential surface of the core member 2. Thereby, the internal magnetic resistance of the permanent magnet 3 relative to the magnetic flux generated from the solenoid 8 is reduced, and the electric power required to be supplied to the solenoid 8 for the purpose of canceling the magnetism of the permanent magnet 3 and driving the armature 4 with the spring force of the sheet spring 5 can be reduced.

FIGS. 3 to 6 show only the core member 2, omitting the solenoids 8. The core member 2 is generally shaped as a ring and defines in its center the central bore 15. The cores 2a are integrally formed with the bottom wall 2c of the core member 2 so as to protrude therefrom in parallel with the outer circumferential wall 2b. In the case of the present embodiment, fan shaped base portions 2d consisting of locally thickened bottom wall portions extend from the outer circumferential wall 2b to the central bore opening 15, and two of the cores 2a project from each of these base portions 2d.

Figure 4:
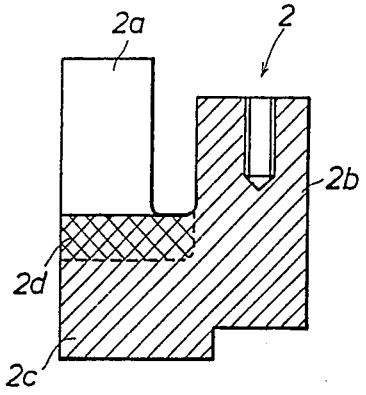
FIGS. 4 and 5 are sectional views taken along lines IV—IV and V—V of FIG. 3, respectively.
Figure 5:
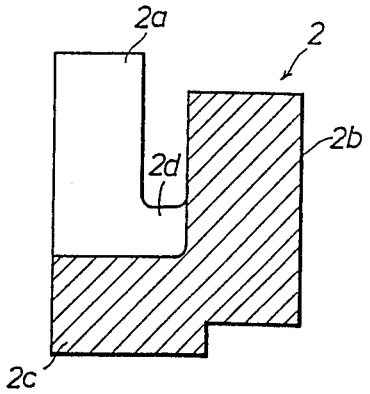

According to the present embodiment, the core member 2 is provided with twenty-four of the cores 2a and, therefore, these twenty-four cores 2a are clustered into twelve groups each consisting of a pair of the cores 2a. Therefore, as shown in FIGS. 4 and 5, the cross-sectional areas of the magnetic paths between the neighboring cores 2a belonging to same groups are made greater than those of the neighboring cores 2a belonging to different groups, and the difference is shown in FIG. 4 by cross-hatching.

Figure 7:
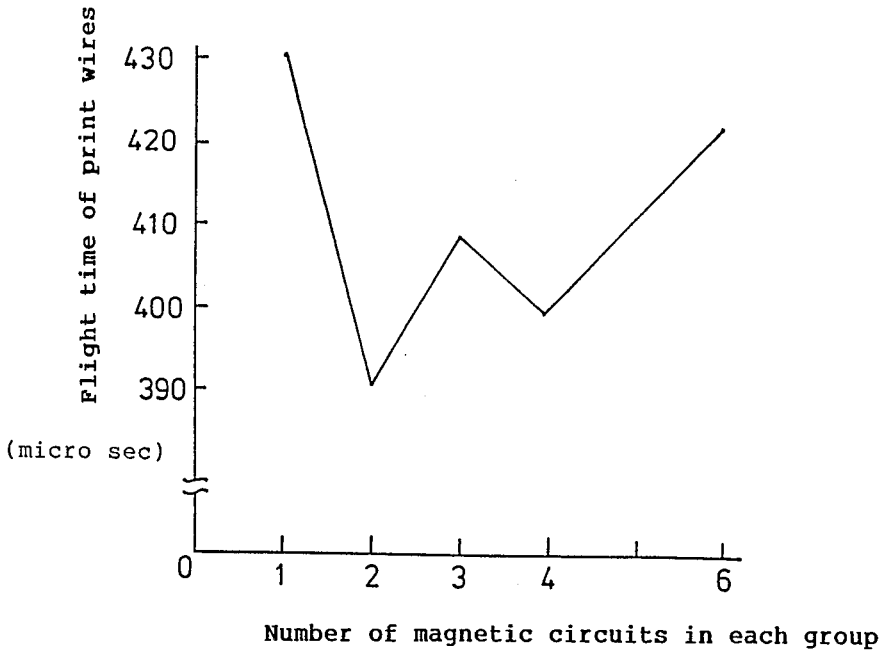
FIG. 7 is a graph comparing the flight times of print wires by grouping the cores into different numbers of cores.

In such a 24-pin print head, the print wires 10 are typically arranged in two rows and in staggered manner at the free end surface 11a of the head nose 11 so that the print wires of the different rows may be alternatingly driven to perform desired prints. According to the present embodiment, the cores 2a belonging to a same group correspond to two of the print wires 10 belonging to the different rows at the free end surface 11a of the head nose 11. FIG. 7 shows the flight times of the print wires when the 12 print wires on one of the rows are driven in a 24-pin print head.

Whereas the flight time of the print wires was approximately 430 micro seconds according to a prior art print head in which the cross sectional areas of the magnetic paths between neighboring cores 2a are uniform without the provision of the base portions 2d, the flight time of the print wires was reduced by approximately 10% to approximately 390 micro seconds according to a print head of the present embodiment in which 24 cores 2a were clustered into 12 groups. Similar measurements were taken in the cases in which the cores were divided into eight, six and four groups and it was found that the flight time of the print wires was reduced in all the cases but the best results were obtained when the cores were divided into twelve groups.

Although the present invention was described in terms of the preferred embodiment, the present invention is not limited by it. For instance, the cross-sectional areas of the magnetic paths between the neighboring cores were made uneven by partially increasing the thickness of the bottom wall but it goes without saying that the same object can be accomplished by providing slots in the portions of the bottom wall located between the cores belonging to different groups instead of partially increasing the thickness thereof.

Thus, according to the present invention, since the print speed can be readily increased for instance by 10%, improving print quality at the same time through improved uniformity of print pressure, the effect of the present invention is quite significant.

What I claim is:

1. A print head, comprising a plurality of circumferentially arranged magnetic circuits for forming magnetic flux paths, each said circuit comprising an armature supported by a spring, a permanent magnet for generating a biasing force on said armature to bias the armature in one direction, and an electromagnet which can be energized so as to cancel the biasing force of the permanent magnet, whereby a print means fixed to each said armature may be driven by energizing the associated electromagnet and thereby driving the associated armature with the restoring force of the spring, said magnetic circuits being clustered into a plurality of pairs by associating each said pair of magnetic circuits with a base portion whereby the cross-sectional area of the magnetic flux path between neighboring magnetic circuits belonging to the same pair is greater than the cross-sectional area of the magnetic flux path between neighboring magnetic circuits belonging to different pairs.

2. A print head as defined in claim 1, wherein each said print means comprises a print wire, the print wires for said plurality of magnetic circuits being so disposed that the print wire free ends are arranged in two rows in staggered manner, and the two magnetic circuits belonging to each pair of magnetic circuits corresponding to the print wires are selected one each from the two different rows.

3. A print head as defined in claim 1, wherein the electromagnets comprise a core member including a circumferential wall, a bottom wall and a plurality of cores secured to said bottom wall, said base portions comprising the portions of said bottom wall located between the two mutually adjacent cores belonging to each of the pairs, said base portion of said bottom wall being greater in thickness than the portions of said bottom wall which are located between the mutually adjacent cores belonging to different pairs.

4. A print head as defined in claim 3 wherein the cores are integrally formed with the bottom wall.

5. A print head as defined in claim 1 wherein the cores are arranged in a circle at equally spaced intervals.

6. A print head comprising a plurality of magnetic circuits each of which comprises an armature supported by a spring, a permanent magnet for generating a biasing force on said armature to bias that armature in one direction, and an electromagnet which can be energized so as to cancel the biasing force of the permanent magnet, whereby a print means which is fixed to each said armature may be driven by energizing the associated electromagnet and thereby driving the associated armature with the restoring force of the spring, said plurality of electromagnets including a core member having a circumferential wall, a bottom wall, and a plurality of cores secured to said bottom wall, said cores being divided into a plurality of groups each of which comprises at least a pair of said cores, the portions of said bottom wall located between each two mutually adjacent cores belonging to a same group being greater in thickness than the portions of said bottom wall located between each two mutually adjacent cores belonging to different groups.

7. A print head as defined in claim 6 wherein the cores are integrally formed with said bottom wall.

8. A print head as defined in claim 6 wherein the cores are arranged in a circle at equally spaced intervals.

* * * * *